US007236139B2

(12) United States Patent
Waschenko

(10) Patent No.: US 7,236,139 B2
(45) Date of Patent: Jun. 26, 2007

(54) LOW BACKSCATTER POLYMER ANTENNA WITH GRADED CONDUCTIVITY

(75) Inventor: Donald P Waschenko, Maple Glen, PA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 146 days.

(21) Appl. No.: 11/009,305

(22) Filed: Dec. 10, 2004

(65) Prior Publication Data

US 2006/0125707 A1 Jun. 15, 2006

(51) Int. Cl.
*H01Q 9/04* (2006.01)

(52) U.S. Cl. ..... 343/790; 343/791

(58) Field of Classification Search ..... 343/700 MS, 343/897, 801, 790, 791; 428/245, 246; 139/419; 442/185, 189

See application file for complete search history.

(56) References Cited

U.S. PATENT DOCUMENTS

| | | | | | |
|---|---|---|---|---|---|
| 4,092,453 | A * | 5/1978 | Jonda | 442/185 |
| 4,803,096 | A | 2/1989 | Kuhn et al. | 427/121 |
| 4,877,646 | A | 10/1989 | Kuhn et al. | 427/121 |
| 4,975,317 | A | 12/1990 | Kuhn et al. | 442/115 |
| 4,981,718 | A | 1/1991 | Kuhn et al. | 427/121 |
| 5,102,727 | A | 4/1992 | Pittman et al. | 442/187 |
| 5,108,829 | A | 4/1992 | Kuhn | 442/115 |
| 5,316,830 | A | 5/1994 | Adams, Jr. et al. | 428/195.1 |
| 5,458,162 | A * | 10/1995 | Sinha | 139/419 |
| 5,493,771 | A * | 2/1996 | Sinha et al. | 29/600 |
| H1523 | H | 4/1996 | Mammone et al. | |
| 5,624,736 | A | 4/1997 | DeAngelis et al. | 428/196 |
| 5,771,567 | A | 6/1998 | Pierce et al. | 29/600 |
| 5,833,884 | A | 11/1998 | Child | 252/500 |
| 5,847,931 | A | 12/1998 | Gaumet et al. | 361/737 |
| 5,959,595 | A * | 9/1999 | Witschen et al. | 343/912 |
| 6,161,761 | A * | 12/2000 | Ghaem et al. | 235/492 |
| 6,248,393 | B1 | 6/2001 | Bunyan et al. | 427/77 |
| 6,249,261 | B1 | 6/2001 | Solberg, Jr. et al. | 343/801 |
| 6,346,491 | B1 | 2/2002 | DeAngelis et al. | 442/110 |
| 6,403,935 | B2 * | 6/2002 | Kochman et al. | 219/545 |
| 6,716,481 | B2 | 4/2004 | DeAngelis et al. | 427/121 |
| 6,947,012 | B2 * | 9/2005 | Aisenbrey | 343/906 |
| 7,115,311 | B2 * | 10/2006 | Arthurs et al. | 428/36.2 |

OTHER PUBLICATIONS

"Electrically Conductive Polymer Wire", www.afrlhorizons.com, pp. 1-2.

Karakisla, Meral et al., "The Preparation of Polyaniline/Polypyrrole Conductive Polymer Films on Polycarbonate-Coated Pt Electrodes", Journal Of Polymer Sciences: Part A Polymer Chemistry, 2000, pp. 51-59, vol. 38, John Wiley & Sons, Inc.

* cited by examiner

*Primary Examiner*—Douglas W. Owens
*Assistant Examiner*—Jimmy Vu
(74) *Attorney, Agent, or Firm*—Maine & Asmus

(57) ABSTRACT

Polymer antenna structures having low reflectivity and high efficiency are disclosed. Wire antennas can be configured from coaxial cable having center conductors and outer conductors made from conductive polymer. Fabrics can also be configured with conductive polymer antenna elements formed in or on the fabric. The conductive polymer antenna elements can be configured with a graded conductivity to facilitate capture (as opposed to reflection) of electromagnetic energy.

17 Claims, 9 Drawing Sheets

Graded Conductivity:
L = Low Conductivity, $\sigma < 10^{-3}$ S/M
M = Medium Conductivity, $\sigma$ between $10^{-3}$ S/M to $10^{4}$ S/M
H = High Conductivity, $\sigma > 10^{4}$ S/M
** $\sigma$ = Conductivity Graded Conductivity:
L = Low Conductivity, $\sigma < 10^{-3}$ S/M
M = Medium Conductivity, $\sigma$ between $10^{-3}$ S/M to $10^{4}$ S/M
H = High Conductivity, $\sigma > 10^{4}$ S/M
** $\sigma$ = Conductivity

LOW BACKSCATTER POLYMER ANTENNA WITH GRADED CONDUCTIVITY

FIELD OF THE INVENTION

The invention relates to antenna structures, and more particularly, to low backscatter polymer antennas with graded conductivity.

BACKGROUND OF THE INVENTION

Antennas are deployed in many applications, and in many different configurations, to receive and transmit electromagnetic energy. Configurations range from basic monopole and dipole wire antennas to complex antenna arrays having multiple elements.

In any such configurations, the antenna or elements making up the antenna must be able conduct electrical signals and currents so that electromagnetic energy can be transmitted and/or received. In addition, the supporting structure of the antenna or antenna elements typically have sufficiently high electrical conductivity to provide shielding for electronics within the structure and to provide electrical symmetry. Given these conductivity requirements, most antennas and antenna structures are fabricated from metals, which generally have good conductive qualities.

One significant problem associated with using metal in antenna systems is that metal generally produces a high degree of reflections of incoming radar signals. Such reflections are sometimes referred to as backscatter or retroreflections. In certain applications, these reflections are undesirable, particularly in applications such as stealth operations or in those applications where low detectability of a deployed antenna system is necessary. This is because the reflections are sent back toward other antennas and/or tracking radars, and can therefore increase a host platform's radar cross section (RCS) caused by the increased RCS of the antenna system causing the reflections. In short, the reflections can be used to identify, track, and/or target the system(s) causing the reflections.

Recently, polymer materials having sufficiently high electrical conductivities have been developed and are commercially available. Examples of such materials include polypyrrole, polycarbazole, polyaniline, polyacetylene, and polythiophene. The electrical conductivity level of these materials can be varied significantly as a function of the dopant level applied to the polymers. This dopant level is determined or otherwise set during the manufacturing process of the polymer. The doped and now conductive polymers can then be used as a coating over materials like fiberglass to provide an electrically conductive composite material that can be used to form parts of the antenna system, thereby reducing that system's effective radar cross section.

However, conventional polymer antenna systems still rely on metallic materials for transmitting and receiving, which remain a significant cause of reflections. For example, metal material is typically used as one of the constituents that form the polymer composite material, or metal coatings or tips are used on the antenna elements in conjunction with the polymer composite. Thus, undesirable reflections (e.g., backscatter and retroreflections) are still a problem for conventional polymer composite antenna systems.

Moreover, significant differences in dielectric constants associated with conventional antenna systems cause lower antenna efficiency. Antenna efficiency is reduced by incident signal that is not captured by the antenna, but re-radiated.

Differences in dielectric constants inhibits some of the electromagnetic energy signals of interest from being captured by the antenna system, which in turn reduces antenna efficiency. This relationship between antenna efficiency and high conductivity represents a longstanding trade that is acceptable for many antenna systems. However, given more demanding requirements associated with today's communication systems, greater efficiencies are desirable.

What is needed, therefore, are polymer antenna structures having low reflectivity and high efficiency.

SUMMARY OF THE INVENTION

One embodiment of the present invention provides a low backscatter antenna having a conductive element for at least one of receiving and radiating information. The antenna includes a conductive polymer center conductor having an exposed portion that forms at least a portion of the conductive element of the antenna, and has a graded conductivity ranging from relatively low conductivity at its perimeter to relatively high conductivity at its center. Such graded conductivity improves the efficiency of the antenna. The antenna may further include a dielectric layer covering the unexposed portion of the conductive polymer to provide an insulating spacer, and an outer conductive polymer layer around the dielectric layer. The outer conductive polymer layer can be in the form of a braid (e.g., as with coaxial cable) or an outer conductive jacket (e.g., as with semi-rigid coaxial cable).

In one particular configuration, the antenna is a dipole antenna formed in part from the exposed portion of the center conductor. Here, an additional one or more strands of conductive polymer is electrically coupled to the outer conductive polymer layer to form the other part of the dipole. The antenna may include a balun. The conductive polymer center conductor can be comprised of a plurality of conductive polymer strands, with strands at the perimeter having the lower conductivity and strands at the center having the higher conductivity. Alternatively, the center conductor can be comprised of a plurality of conductive polymer strands (having uniform conductivity), with strands at the perimeter being coated with a conductive polymer layer having lower conductivity relative to conductivity of the strands themselves, thereby providing the graded conductivity. Alternatively, the center conductor can be a single strand of conductive polymer that is coated with a conductive polymer layer having lower conductivity relative to conductivity of the strand itself, thereby providing the graded conductivity.

Another embodiment of the present invention provides a low backscatter antenna having a conductive element for at least one of receiving and radiating information. The antenna includes a plurality of nonconductive strands interweaved with one another, and one or more conductive polymer strands interweaved with the nonconductive strands, so as to provide one or more conductive elements of the antenna. Each of the one or more conductive elements of the antenna can have a graded conductivity ranging from relatively low conductivity at its outer surface to relatively high inner conductivity.

The antenna may further include one or more feed circuits operatively coupled to respective conductive polymer strands. In one particular configuration, there are N conductive polymer strands and the antenna is configured as an N/2 element dipole array. Here, each of the N conductive polymer strands can be operatively coupled to a feed circuit. A fabric formed by the nonconductive strands and the conductive polymer strands has a first side and a second side, and the conductive elements can be on both sides or just one side. The feed circuitry can be on the same side as the corresponding elements being fed, or on the opposite side.

Another embodiment of the present invention provides a low backscatter antenna having a conductive element for at least one of receiving and radiating information. The antenna includes a plurality of nonconductive strands formed into a fabric, and one or more conductive polymer coatings on the fabric, so as to provide one or more conductive elements of the antenna. Each of the one or more conductive elements of the antenna can have a graded conductivity ranging from relatively low conductivity at its outer surface to relatively high inner conductivity. This graded conductivity can be provided using multiple layers of conductive polymer, each layer having a corresponding degree of conductivity.

The antenna may further include one or more feed circuits that are operatively coupled to respective conductive elements of the antenna. In one particular configuration, at least one of the conductive elements of the antenna has a shape defined by boundaries that are not parallel to the nonconductive strands. For example, the antenna can have N conductive elements, where the antenna is configured as an N/2 element bow-tie array. Other element shapes and configurations will be apparent in light of this disclosure. The fabric can have conductive elements on both sides or just one side.

Another embodiment of the present invention provides a fabric having graded conductivity. The fabric includes a plurality of nonconductive strands formed into a fabric, and one or more conductive polymer strands or coatings formed into or on the fabric, so as to provide one or more conductive regions of the fabric. Here, at least one of the conductive regions has a graded conductivity ranging from relatively low conductivity at its outer surface to relatively high inner conductivity.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1A:
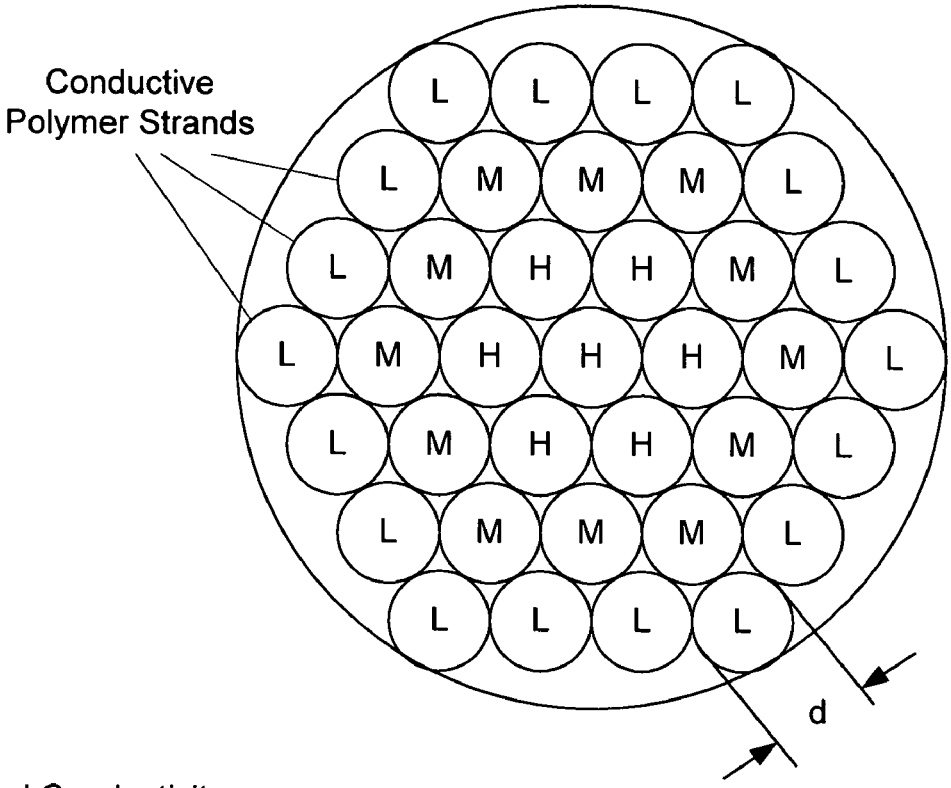
FIG. 1*a* shows a cross-section view of conductive polymer strands that form a center conductor of a coaxial cable, configured with graded conductivity in accordance with one embodiment of the present invention.

Embodiments of the present invention provide polymer antenna structures having low reflectivity and high efficiency. In particular, an antenna configured as described herein remains an efficient radiator at the low bands of operation yet at higher frequencies is nonconductive or even absorptive. Thus, backscattered high frequency energy is prevented or otherwise substantially reduced, thereby reducing the radar cross section of the antenna.

In addition, conductive polymer elements of the antenna can be configured with a graded conductivity. For instance, the conductivity at the outer surface of the conductive polymer elements can be closer to that of air, thereby facilitating capture of the electromagnetic energy into the conductive polymer. The conductivity toward the inner portion of the conductive polymer elements can be higher (closer to that of metal), thereby facilitating conduction of the received electromagnetic energy into the receiver and processing electronics associated with the backend of the antenna system.

Overview

Electrically conductive polymers are becoming more stable and advanced in their design and are commercially available. A unique property of some conductive polymers and composite materials is that their conductivity can be varied during their fabrication process. The range of conductivity lies between that of conductors (e.g., metals) and insulators (e.g., Teflon) and can be varied by changing the doping levels of the polymer material that forms or otherwise coats the basic material. Polypyrrole and polyanaline are examples of electrically conductive polymers.

Conductive polymers offer an advantage over metal conductors with regard to low backscatter antenna designs since the conductive polymers conductivity can be tailored over a specific operating electromagnetic frequency range. By modifying the dopant level in the manufacturing process of the conductive polymer, one can change the conductivity as a function frequency, changing the electrical properties of the antenna. In more detail, components made with the conductive polymers can be tailored to exhibit good electrical conductivity over the desired electromagnetic frequency band of operation for the antenna, and also to exhibit poor electrical conductivity outside or above the electromagnetic operating band, particularly at frequencies at which typical tracking radars or missile seekers operate. These unique frequency tailored conductive properties are not possible with metallic conductors, and when used judiciously in the manufacturing of antennas and antenna systems can reduce backscatter, thereby reducing that system's effective RCS.

For example, low frequency antennas (e.g., operating frequency under 3 GHz) can be manufactured using conductive polymers, where the polymers are doped sufficiently to allow high conductivity at the target band of operation, but remain nonconductive at higher frequencies such as those used by tracking radars (e.g., operating frequency over 3 GHz). This is in contrast to metal antenna elements, which are generally conductive at all frequencies.

Conductive polymers can be made into many forms, such as sheets, fabrics, coatings, or center conductors. In any such cases, the basic unit of the conductive polymer can be provided as a strand. The conductivity of such conductive polymer strands is controlled by the doping process during manufacturing of the conductive polymer, as is known.

In application, an individual strand can be used as a center conductor (e.g., of a coaxial cable). Similarly, a number of strands can be grouped to form a center conductor. The conductive polymer strands can also be weaved or otherwise formed into a fabric and used as the braid or outer conductor of a coaxial cable. Similarly, conductive polymers can be applied as coatings to non-conductive individual fibers, filaments, or strands. These coated fibers, filaments or strands can be used in the manufacturing of fabrics by plaiting, felting, knitting, braiding, or interweaving processes. Also, a non-conductive fabric or textile or sheet material can be coated with a conductive polymer in a controlled manner as to achieve a particular conductivity and pattern. Electrically or magnetically conductive polymers that are commercially available, such as polypyrrole or polyanaline, can be incorporated into textiles to provide this conductivity.

As previously noted, antenna efficiency is reduced by incident signal that is not captured by the antenna but reradiated. As with dielectric materials, the propagation of electromagnetic signals across boundaries of dissimilar materials can cause reflections; so does a discontinuity in conductivity. Thus, antenna efficiency can be improved by minimizing the discontinuity between both nonconductive and conductive boundaries, as well as the boundaries between the two. The propagation media between the conductive and nonconductive regions may take the form of, for example, simple free space or some dielectric media such as embedment foams or absorbers in some installed radiating structures such as a leading edge of an aircraft. The efficiency can be improved by grading the conductivity of the conductive elements to better transition to the surrounding propagation medium.

Polymer Center Conductor

Figure 1B:
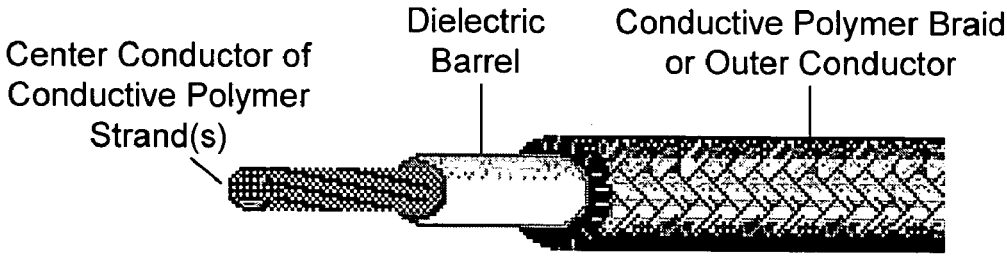
FIG. 1*b* shows an example configuration of a coaxial cable having its center conductor and braid/outer conductor made of conductive polymers, in accordance with one embodiment of the present invention.

FIG. 1*a* shows a cross-section view of conductive polymer strands that form a center conductor of a coaxial cable. FIG. 1*b* shows an example configuration of a coaxial cable having its center conductor and braid/outer conductor made of conductive polymers. Note that the coax can include a braid and outer insulting jacket. Alternatively, the coax can be semi-rigid coaxial cable, where there is no braid or outer insulation jacket. Rather, there is a center conductor, dielectric barrel, and outer conductor. As can be seen in FIG. 1*a*, each of the strands making up the center conductor can have a common diameter, d. Note that the center conductor can also be made up of strands having non-uniform diameters. In addition, each strand can have its own conductivity, or dielectric constant K.

In this example, the conductivity ($\sigma$) of the center conductor is graded. In particular, the strands at the perimeter of the center conductor have a relatively low conductivity, L (e.g., $\sigma$ is less than $10^{-3}$ Siemens per Meter, or S/M), and the strands at the center of the center conductor have a relatively high conductivity, H (e.g., $\sigma$ is greater than $10^4$ S/M.). In addition, an intermediate layer of strands between the outer strands and the center strands has a medium conductivity, M (e.g., $\sigma$ is between $10^{-3}$ S/M and $10^4$ S/M). Such a graded conductivity will improve antenna efficiency of the center conductor by facilitating the absorption of incident electromagnetic energy toward the more conductive polymer strands of the center conductor. If the outer layer of strands had a higher conductivity, such as that associated with metal, then a greater percentage of the incident electromagnetic energy would be reflected out of the antenna system (due to the extremely high difference in dielectric constant between air (1) and metal ($\infty$), thereby resulting in lower antenna efficiency.

Conductive Polymer Weave

FIGS. 2*a* through 2*f* show example weaves of conductive polymer strands that form part of an antenna structure, including the radiating elements. Generally, single or bundled conductive polymer strands can be woven with conductive or nonconductive adjacent strands. If woven with nonconductive strands in a controlled pattern, the resulting textile would result in both conductive and nonconductive regions. Patterns of conductive and nonconductive strands would result in embedded conductive paths that could be either radiating or non-radiating elements of an electromagnetic antenna or electric circuit. Resulting textiles have applications as, for example, antennas, circuits, and frequency selective surfaces. Note that the fibers of the weaves can be individual conductive polymer strands or groups of conductive polymer strands.

Figure 2A:
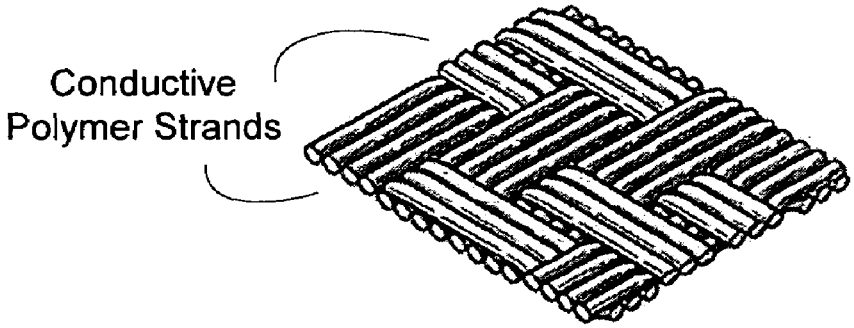
FIGS. 2*a* through 2*f* show example weaves that include conductive polymer strands that can form part of an antenna structure, including the radiating elements, in accordance with embodiments of the present invention.
Figure 2B:
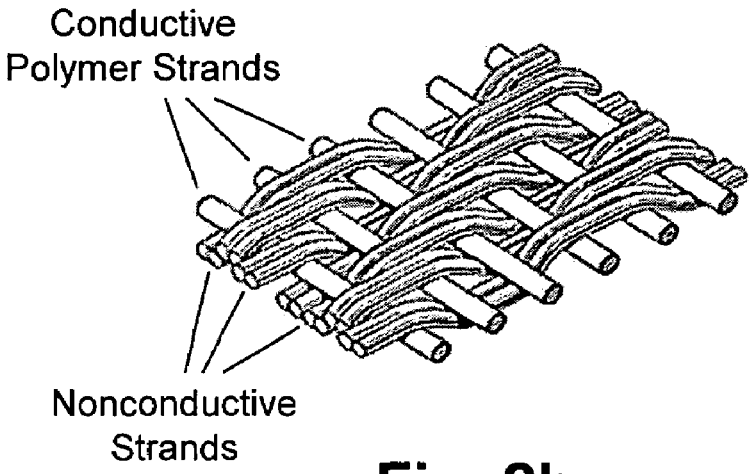
Figure 2C:
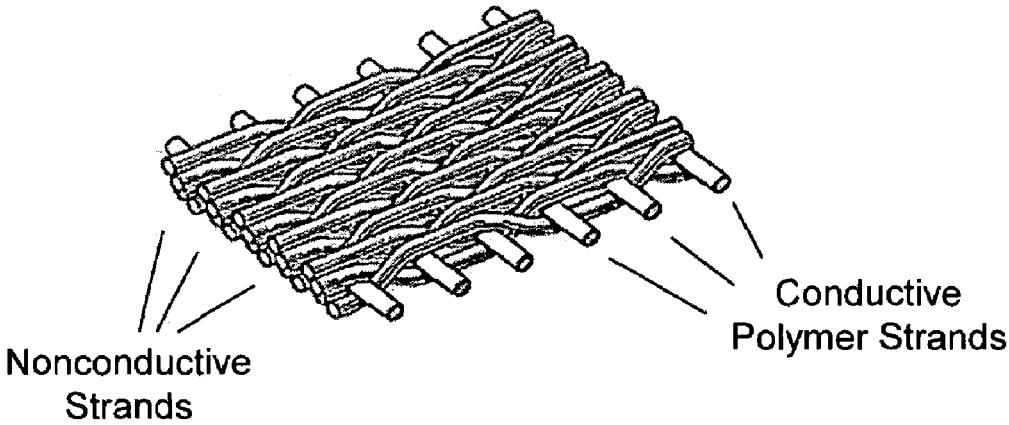
Figure 2D:
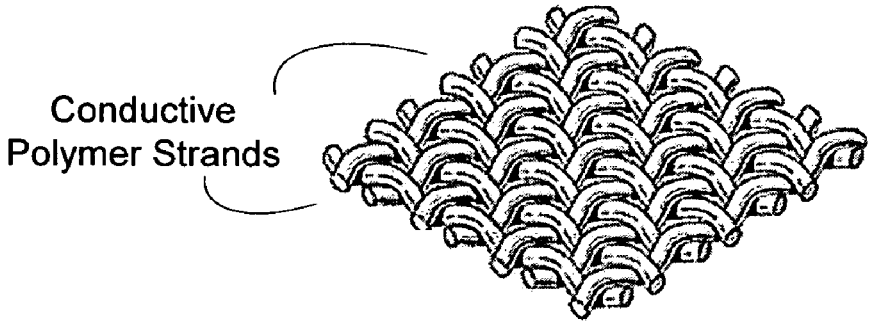
Figure 2E:
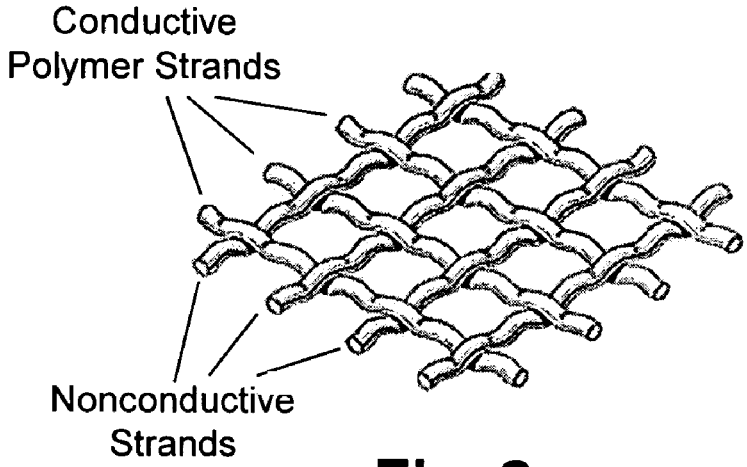
Figure 2F:
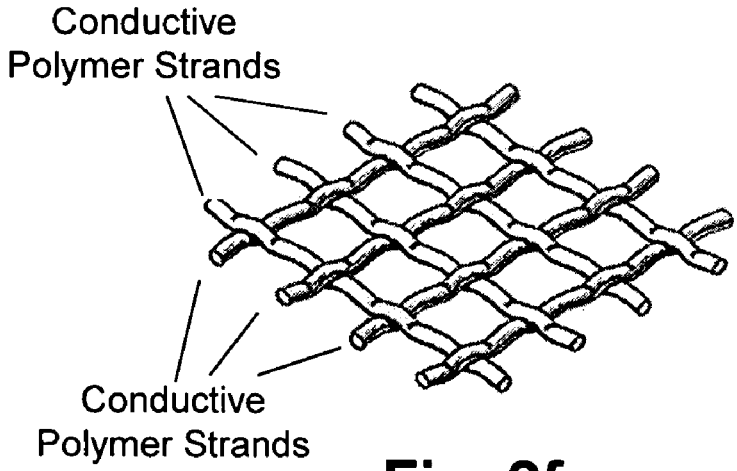

FIG. 2*a* shows an example weave where groups of three conductive polymer strands are interwoven with groups of four conductive polymer strands. FIG. 2*d* provides another example weave of conductive polymer strands. In either case, the resulting weave essentially provides a fabric that can you used as portions of an antenna system, including the radiating portions. FIGS. 2*b* and 2*c* each show example weaves where single conductive polymer strands (or groups of conductive polymer strands operating together to form an overall conductor) are interwoven with nonconductive strands to provide another type of antenna fabric. FIGS. 2*e* and 2*f* each show looser weaves including conductive polymers only (FIG. 2*f*), or both conductive and nonconductive strands (FIG. 2*e*).

As will be apparent in light of this disclosure, the density of the weave, as well as its makeup, can be varied to provide specific antenna configurations and capabilities. Each conductive polymer strand of a weave can have the same conductivity, so as to provide a group of strands having uniform conductivity. Alternatively, individual strands or groups of strands having one conductivity can be placed adjacent to other strands or groups of strands having different conductivities, thereby providing a graded conductivity. Likewise, a weave employing relatively high conductive polymer strands can be coated (after the weave is completed) with a relatively low conductive polymer to provide graded conductivity. A number of such coats could also be applied, with each coat having a thickness and conductivity to effect an overall graded conductivity. Conductive polymer coatings could also be used to provide conductivity to nonconductive strands or fabric, as will be apparent in light of this disclosure.

As previously explained in reference to coaxial cable based antennas, employing an arrangement of graded conductive polymer having lower conductivity on the perimeter (or outer surface) and higher conductivity in the core yields higher efficiency in electromagnetic antennas. Conversely, the greater the difference in conductivity from air to an electromagnetic antenna element made of graded conductive polymer, the greater the amount of incident electromagnetic waves that are reflected rather than captured by the antenna. Thus, an antenna manufactured with a graded conductivity rather than a uniform conductivity would yield higher efficiency by capturing more of the incident electromagnetic wave energy rather than reflecting a portion of that energy. Whether uniform or graded conductivity is used will depend on the particular application and the desired performance criteria.

Wire Antenna Structures with Polymer Coax

Many conventional wire antennas are manufactured using standard coaxial cable. Example wire antenna structures include monopole, sleeve dipole, broadband dipole, and helical. Balun techniques can be further employed as necessary to provide proper impedance matching and balancing, as is conventionally done.

If, in accordance with an embodiment of the present invention, the coaxial cable of a wire antenna was made using conductive polymers rather than copper or other conventional metal conductors, then the conductivity, efficiency, and backscatter of the antenna would vary as a function of the frequency. For low frequency applications, the conductive polymer coax antenna would be as efficient as a standard metallic wire antenna. Unlike such standard metallic antennas, however, conductive polymer wire antennas can be manufactured with selective conductivity that decreases at higher frequencies and becomes nonconductive at even higher frequencies.

Employing such conductive polymers in the manufacturing of electromagnetic antennas in place of metallic radiators will substantially reduce backscatter and thus radar cross section (RCS) at elevated frequencies, and potentially at frequencies of operation of the antenna (if so desired). Additionally these same attributes can be used to reduce or eliminate cosite interaction/interference between antennas operating at different frequency bands. For instance, consider an antenna application having both a high frequency antenna portion and a low frequency antenna portion. The higher frequency antenna portion can be manufactured with conductive polymers that are doped to provide a higher conductivity, while the lower frequency antenna can be manufactured with conductive polymers doped to provide a lower conductivity at the higher operating frequencies of the other antenna.

Figure 3A:
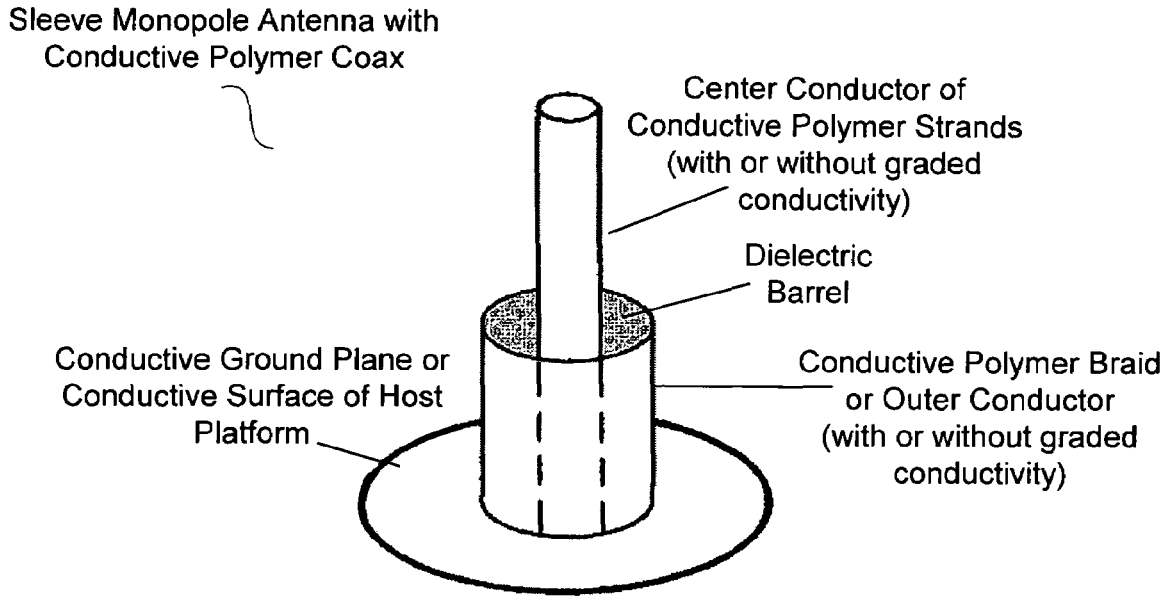
FIG. 3*a* illustrates a sleeve monopole antenna configured with conductive polymer coax in accordance with an embodiment of the present invention.
Figure 3B:
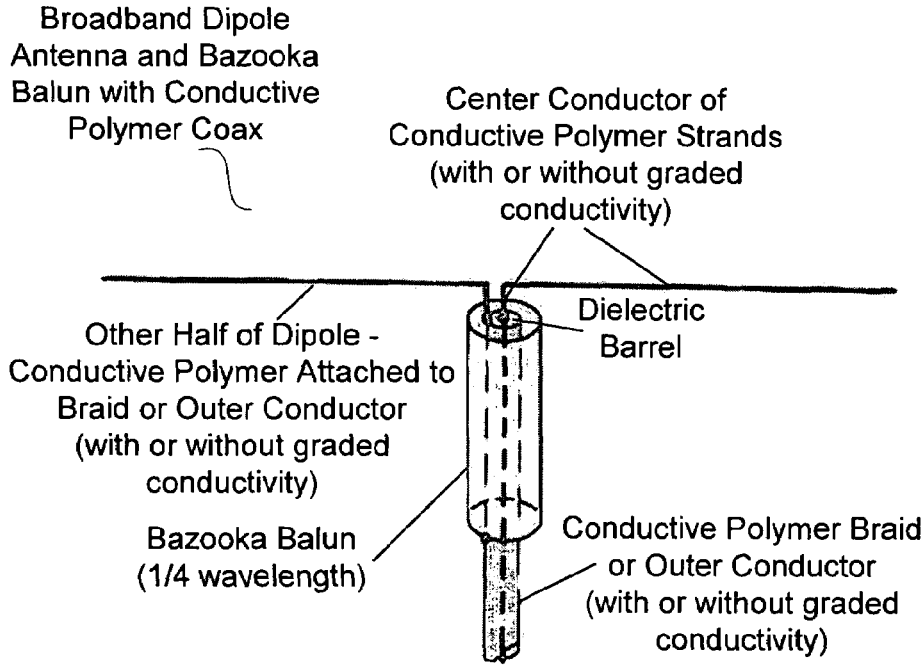
FIG. 3*b* illustrates a broadband dipole antenna and bazooka balun configured with conductive polymer coax in accordance with an embodiment of the present invention.
Figure 3C:
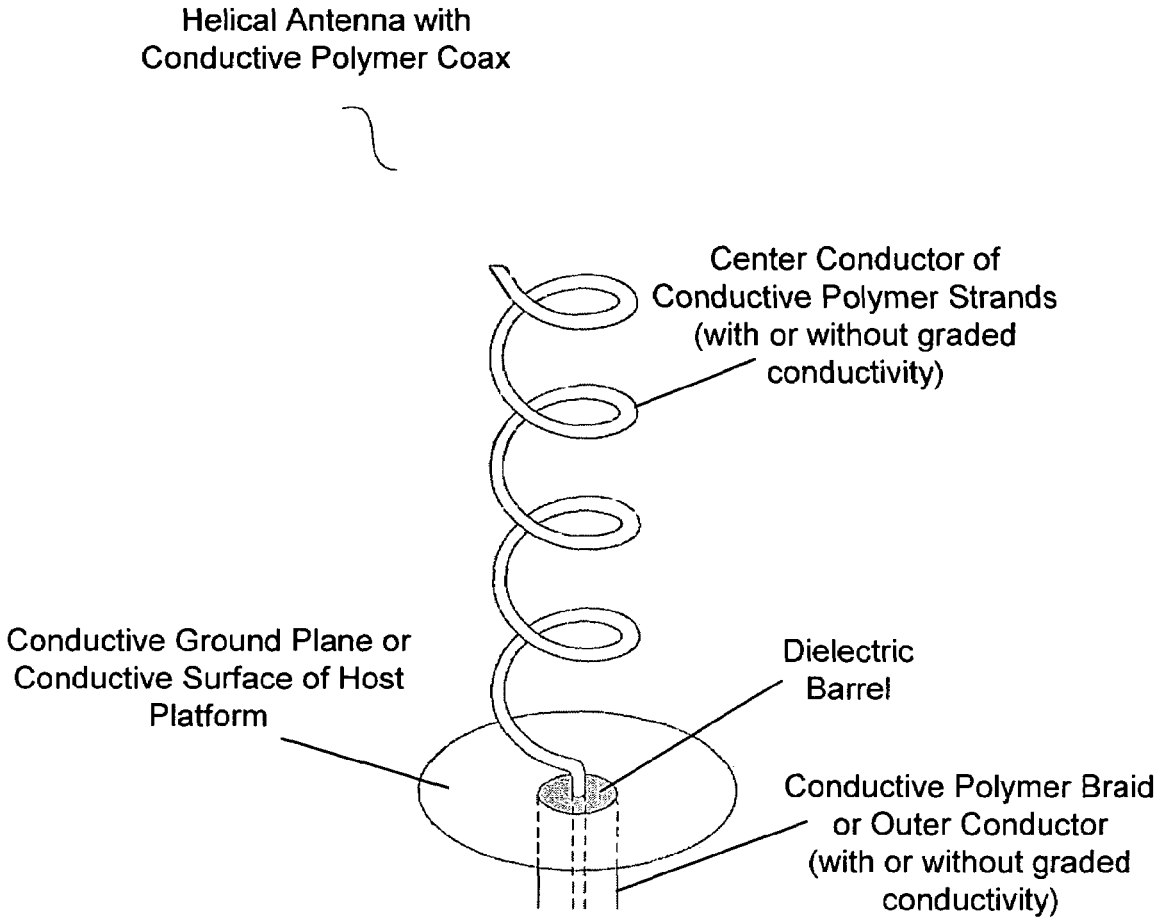
FIG. 3*c* illustrates a helical antenna configured with conductive polymer coax in accordance with an embodiment of the present invention.

Specific wire antenna structures with polymer coax are illustrated in FIGS. 3*a*, 3*b*, and 3*c*. In each case, the antennas are configured to have conductivity that is frequency dependent (e.g., conductive at frequencies below 3 GHz and non-conductive or less conductive at frequencies above 3 GHz). This includes both the antenna elements and their supporting structures.

In particular, FIG. 3*a* illustrates a sleeve monopole antenna configured with conductive polymer coax in accordance with one embodiment of the present invention. As can be seen, this antenna structure includes a coaxial cable whose center conductor and braid/outer conductor are fabricated using conductive polymer (e.g., polypyrrole or polyanaline). The dielectric barrel can be made of conventional material, such as polystyrene, polypropylenes, and polyolefins. Note braided or semi-rigid coax can be used here. Numerous configurations can be realized, and details such as the diameter of the center conductor, length of exposed center conductor, length of exposed dielectric barrel, operating frequency, and the use of braided or semi-rigid coax will depend on the particular antenna application. A variant of the sleeve monopole antenna configuration is the sleeve dipole antenna configuration, which is constructed in much the same way, except the conductive ground plane is removed and replaced by an image of the upper monopole structure.

In any case, further note that the center conductor can be made of a single conductive polymer fiber or a group of conductive polymer fibers. In addition, and as explained in reference to FIG. 1*a*, the center conductor can be provided with graded conductivity to improve the efficiency of the sleeve monopole antenna. In another graded conductivity embodiment, assume the polymer center conductor has a uniform relatively high conductivity. Here, the graded conductivity could be provided by coating the polymer center conductor with a lower conductivity polymer. Multiple coats could be used to provide the grating, with each layer of the grating having a thickness set to encourage a high degree of incident electromagnetic energy to propagate into the higher conductivity portion of the center conductor.

The braid/outer conductor could also be configured with graded conductivity, such as a polymer fabric or composite having a high conductivity (e.g., $\sigma$ is greater than $10^4$ S/M) that is covered with a low conductivity (e.g., $\sigma$ is less than $10^{-3}$ S/M) coating. Multiple coatings or layers can be used here as well to provide various degrees of conductivity grading. The braid/outer conductor is attached (e.g., with conductive adhesive) to the conductive ground plane or conductive surface of a host platform. This conductive ground plane or platform surface can be, for example, part of a ship (e.g., mast or hull), aircraft (e.g., wing), humvee (e.g., hood or quarter panel), or any other suitable surface that is accessible.

FIG. 3*b* illustrates a broadband dipole antenna and bazooka balun configured with conductive polymer coax in accordance with another embodiment of the present invention. Here, the dipole antenna element is provided by the polymer center conductor bent over to one side, and another strand or group of strands of conductive polymer are bent over to the other side and connected (e.g., with conductive adhesive) to the braid or outer conductor of the coax. This is a conventional configuration, except for the use of conductive polymer to form the radiating element of the dipole and/or the braid/outer conductor. Implementation details such as the diameter of the center conductor, the length of exposed antenna conductor, operating frequency, and the use of braided or semi-rigid coax will depend on the particular antenna application.

Again, the dipole can be configured with graded conductivity, where the outer conductivity of the antenna element is relatively lower (e.g., by virtue of an outer conductive polymer layer or group of strands having a resistivity closer to that of air, with resistivity equal to the inverse of conductivity) and the inner conductivity of the antenna element is relatively higher (e.g., by virtue of an inner conductive polymer layer or group of strands having a resistivity closer to that of copper). Intermediate conductive polymer layers can be used to provide intermediate conductivities/resistivities between these low and high conductivities to facilitate absorption of electromagnetic energy into the antenna system.

The braid/outer conductor could also be configured with graded conductivity, as discussed in reference to FIG. 3*b*. In this example, a $\lambda/4$ bazooka balun is provided that can also be made from conductive polymer, and have graded conductivity as described herein. Conductive polymer composites, braids, or fabrics can be used to form the balun, as well as the conductive braid/outer conductor.

FIG. 3*c* illustrates a helical antenna configured with conductive polymer coax in accordance with another embodiment of the present invention. The same principles discussed in reference to FIGS. 3*a* and 3*b* equally apply here. In this example embodiment, the conductive polymer center conductor is formed into the helical antenna element. This element can be formed from a single strand of conductive polymer or a group of conductive polymer strands. In addition, the polymer center conductor can be provided with graded conductivity to improve the efficiency of the antenna, by virtue of one or more conductive polymer coatings or by virtue of grouped conductive polymers having different conductivities, as previously discussed.

As previously discussed, the conductive polymer braid/outer conductor can also be configured with graded conductivity, and is attached (e.g., with conductive adhesive) to the conductive ground plane or conductive surface of a host platform. Note that fibers or strands of the braid/outer conductor can be used to form a radial line ground plane on a host platform that is nonconductive in the region of installation.

Numerous other antenna configurations will be apparent in light of this disclosure, and include, for example, monopole antennas mounted on buildings, ground planes, ground vehicles, air vehicles, and ships. Other example configurations include trailing wire antennas (such as those deployed from an airplane or ship) rods, cones, discs, discones, bicones, loops, zigzags, log-periodics, etc.

Fabric Polymer Antenna Structures

Figure 4A:
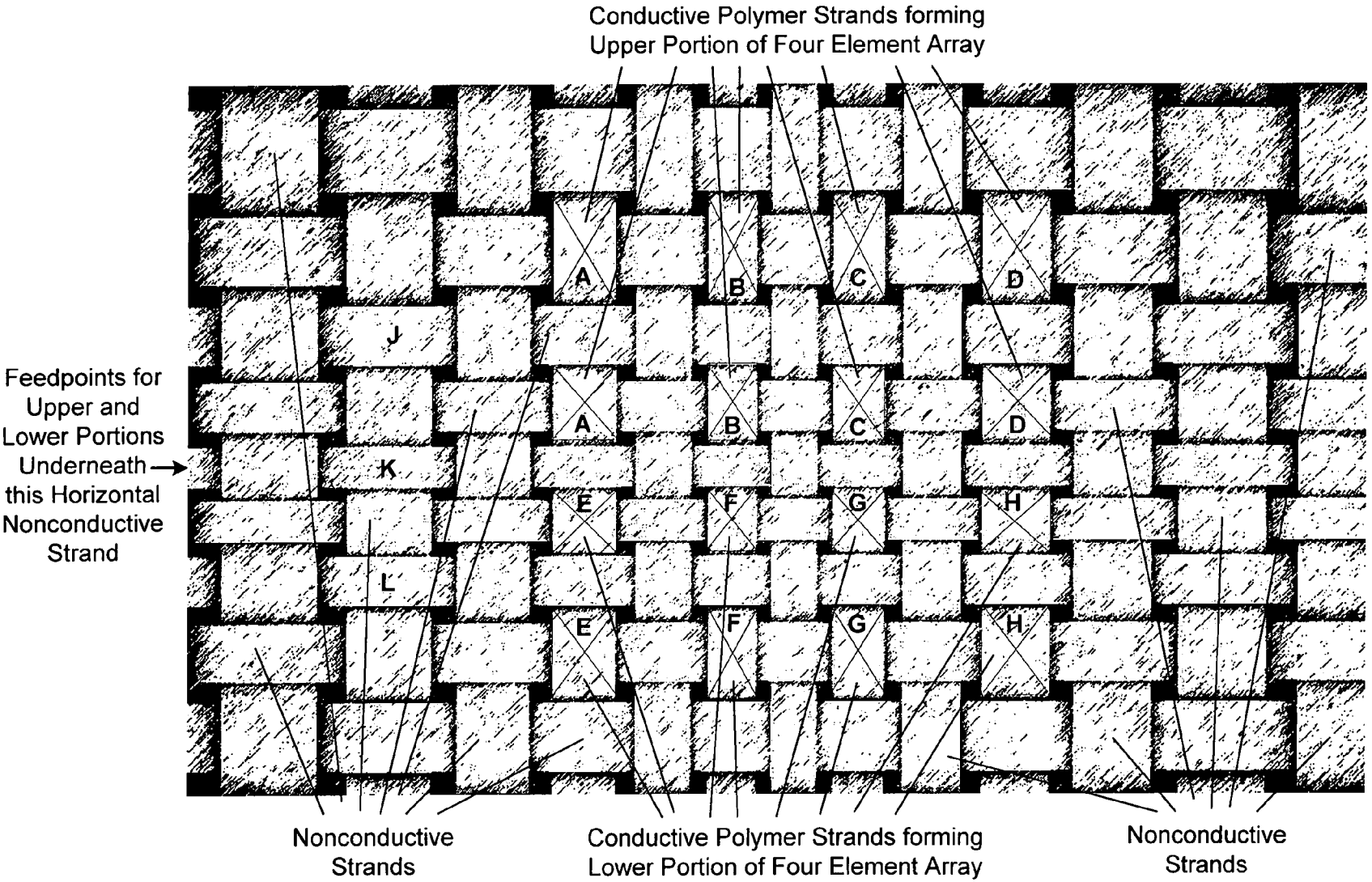
FIG. 4*a* illustrates strands of conductive polymers woven with nonconductive strands to create a four element low backscatter dipole array configured in accordance with an embodiment of the present invention.

FIG. 4*a* illustrates strands of conductive polymers woven with nonconductive strands to create an N element low backscatter dipole array configured in accordance with an embodiment of the present invention. Here, N equals four. This dipole antenna array is created using conductive polymer strands interwoven with nonconductive strands. Stands are intended herein to encompass all components such as fibers, filaments, threads, and all other such strands that can be used used in the manufacuture of a fabric or textile. The creation of the textile/fabric/cloth can be carried out using conventional processes, such as plaiting, braiding, interweaving or other textile techniques.

Figure 4B:
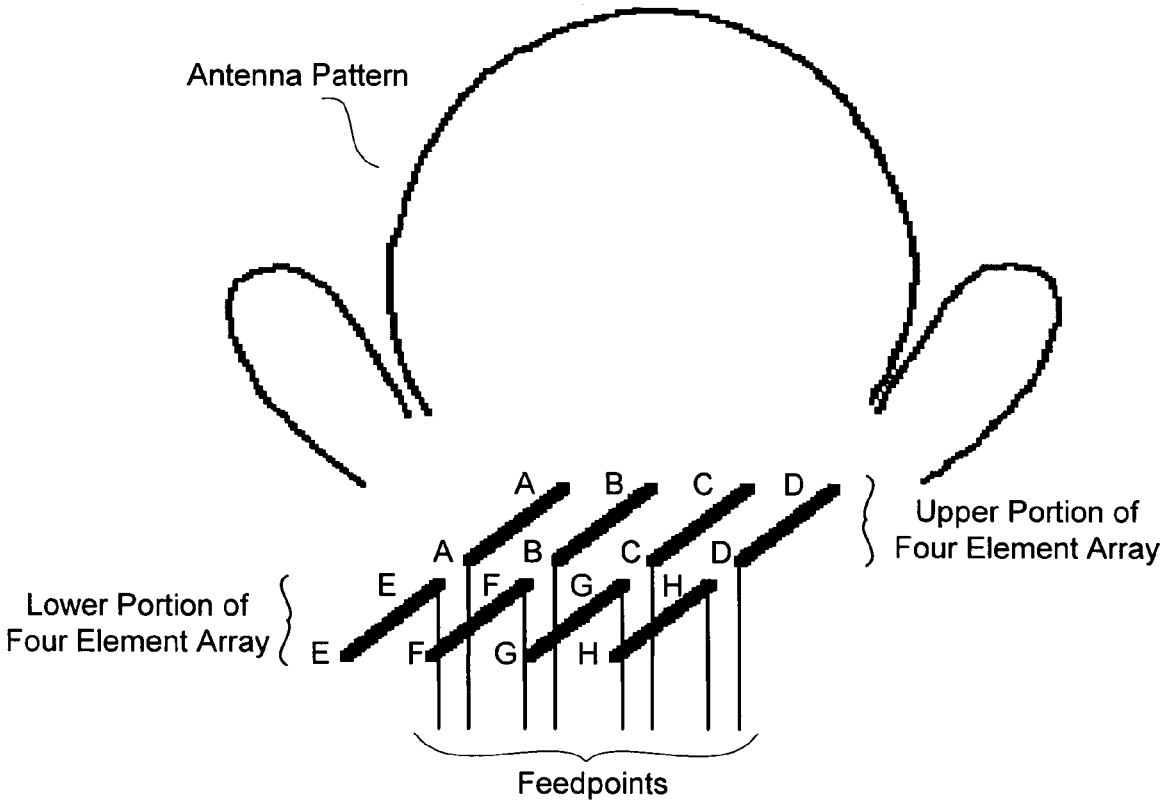
FIG. 4*b* illustrates the schematic and antenna pattern of the four element low backscatter dipole array shown in FIG. 4*a*.

In this particular fabric example, the elements of the four element array are indicated by an "X" and are divided into two groups. One group is the upper portion of the four element array, and the other group is the lower portion of the four element array. FIG. 4*b* illustrates the schematic and antenna pattern of the four element array, and shows the upper and lower portion elements. Each of the four elements is half in the upper portion and half in the lower portion.

In more detail, there are four conductive polymer strands that make up the upper portion (strands A, B, C and D), and another four conductive polymer strands that make up the lower portion (strands E, F, G and H). Note that conductive polymer strands A and E are two separate strands. Likewise, strands B and F are two separate strands. Likewise, strands C and G are two separate strands. Likewise, strands D and H are two separate strands. Each of the conductive polymer strands is associated with a feedpoint that is underneath the horizontal nonconductive strand K as designated in FIG. 4*a*. Note that the feeds could also be implemented on the same side as the four elements. In either case, the feed circuitry could be enclosed in a non-reflective enclosure FIG. 4*b* schematically shows the feedpoints in relation to the conductive polymer strands. Note that each of the conductive polymer strands is weaved into the overall fabric, where some nonconductive strands (e.g., strands J and L) travel over the conductive polymer strands. Variations on this embodiment will be apparent in light of this disclosure. For instance, the four elements of the array could be formed by coating nonconductive strands with a conductive polymer to form conductive portions A, B, C, D, E, F, G, and H. The corresponding feeds could then be connected to the respective coated sections. Also, note that the other side of the fabric could also be configured with elements, thereby providing an antenna array on each side of the fabric.

Figure 5A:
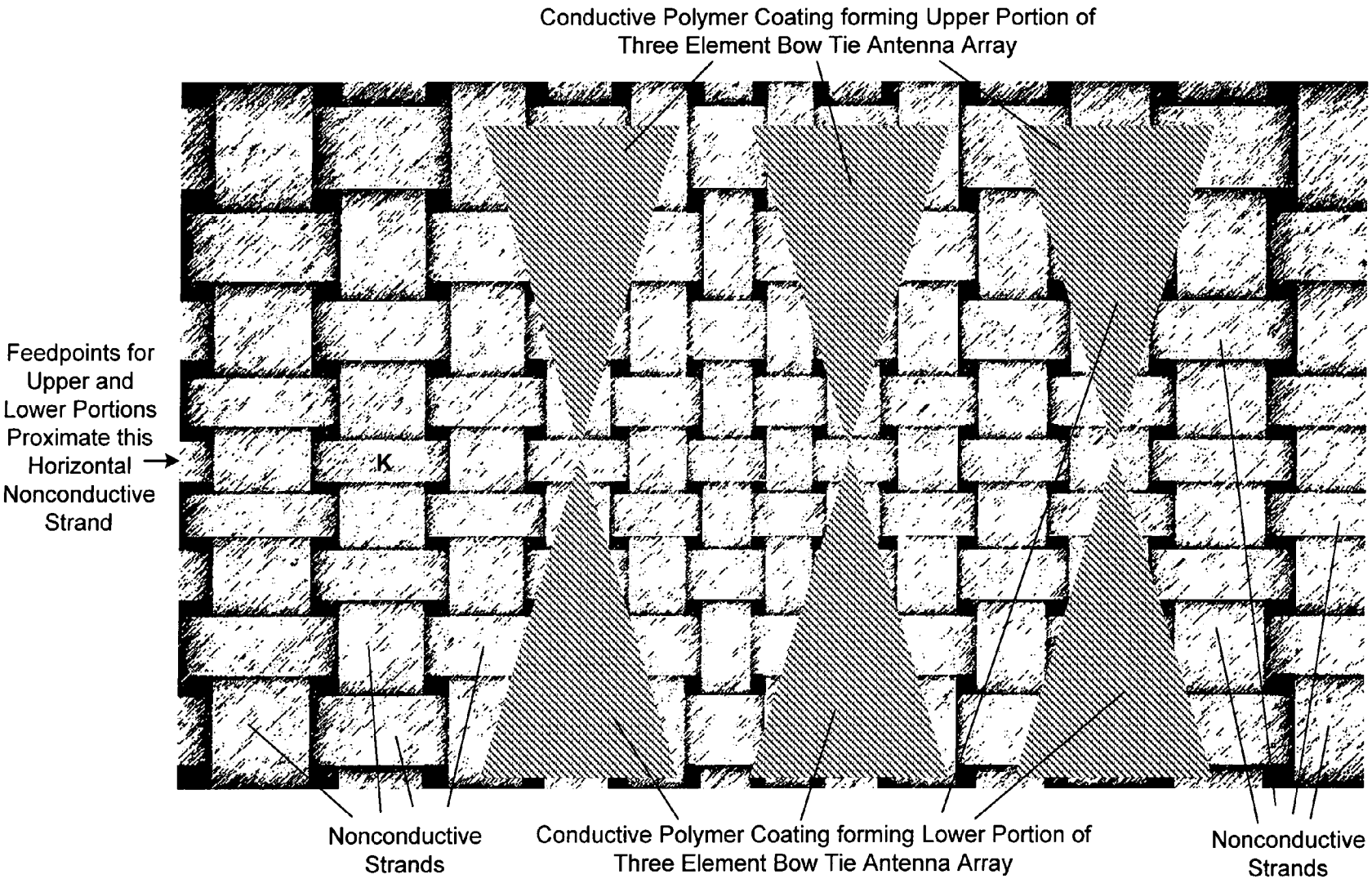
FIG. 5*a* illustrates selected regions of a non-conductive fabric coated with conductive polymers to create a three element low backscatter bow-tie array configured in accordance with an embodiment of the present invention.
Figure 5B:
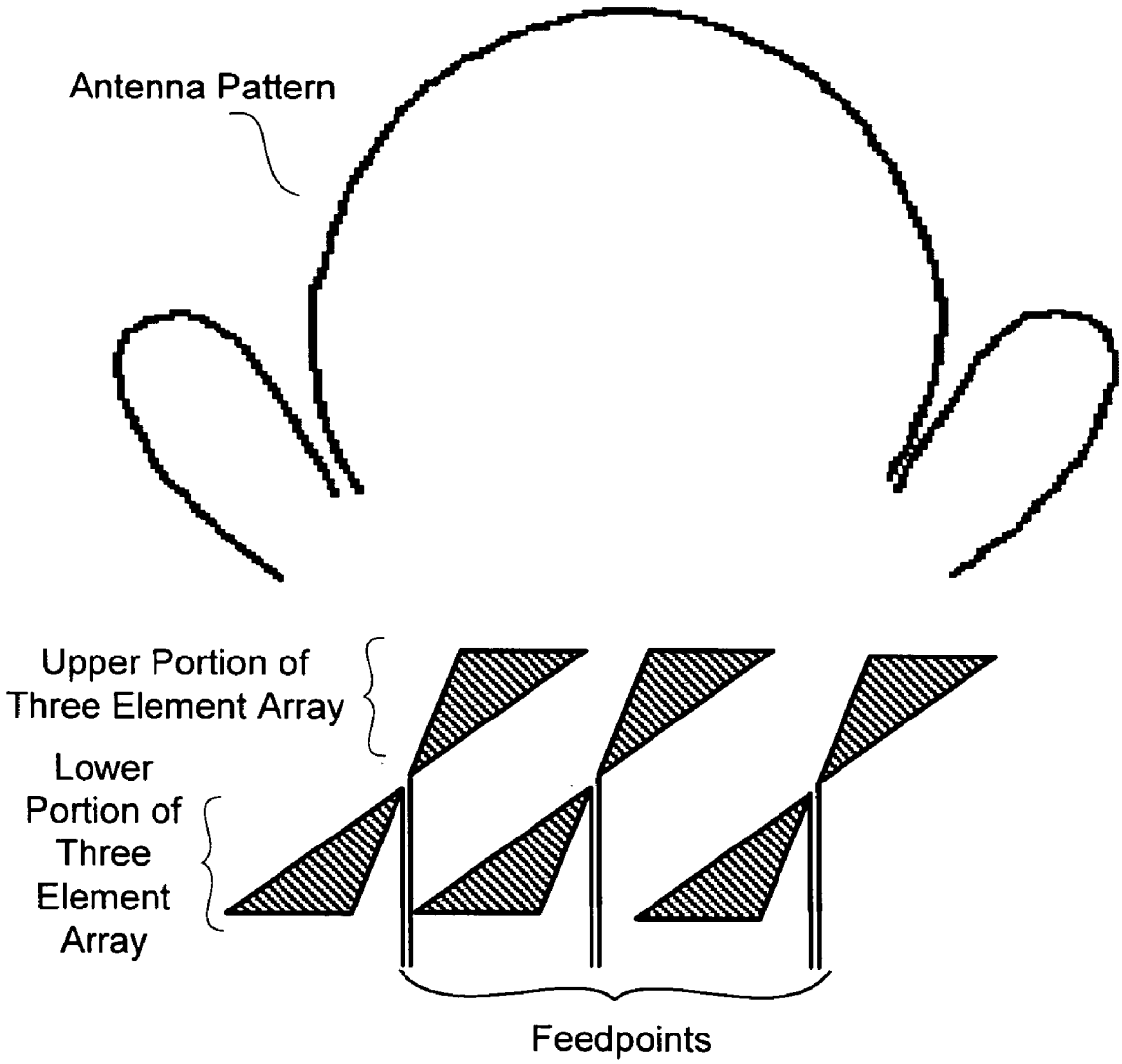
FIG. 5*b* illustrates the schematic and antenna pattern of the three element low backscatter bow-tie array shown in FIG. 5*a*.

FIG. 5*a* illustrates selected regions of a non-conductive fabric coated with conductive polymer to create a three element low backscatter bow-tie array configured in accordance with an embodiment of the present invention. FIG. 5*b* illustrates the schematic and antenna pattern of this three element array. Here, the fabric was made with nonconductive strands using a conventional over-under weave or other such fabric forming technique. Once the fabric is completed, the upper and lower portions of the three element bow-tie array are coated onto the fabric as shown. For instance, the underlying fabric (e.g., polyester or flexible plastic) could be coated with a solution doped with polypyrrole. The coated fabric could then be integrated in composite pre-preg materials such as S2/Epoxy or Quartz cyanate ester to provide a semi-flexible fabric configured with antenna elements that can be cured in a flat configuration or a conformal configuration that yields the desired antenna structure. Such a coated embodiment is particularly useful where the antenna elements have shapes (e.g., bow-tie) defined by boundaries that are not parallel to shape boundaries of the nonconductive strands (which are generally rectangular).

Just as with the four element antenna array of FIGS. 4*a* and 4*b*, the feedpoints to the upper and lower portions of the bow-tie elements can be provided on the opposite side of the fabric. For example, the feedpoints could be provided by piercing the fabric and coupling the feed circuitry to the corresponding conductive polymer (at the point of the triangle pattern proximate the horizontal strand K designated in FIG. 5*a*). The feedpoint could be configured, for example, as shown in FIG. 3*b*, where the horizontal conductive polymer portions of the dipole represent the corresponding bow-tie element coated on the fabric, and the coax provides the feed. Other conventional or custom feed circuitry can be used here as well.

Alternatively, and just as with the embodiment of FIGS. 4*a* and 4*b*, the feedpoints could be on the same side as the bow-tie elements (and properly coated or enclosed to inhibit undesirable reflections). This fabric could also be configured with antenna elements on both sides. Further note that multiple layers of fabric could be employed to provide a unique distribution of antenna radiating sections, or an array of radiating elements with unique reflection and transmission properties as a function of frequency and incidence angle.

Thus, embodiments of the present invention can be used to provide a new class of polymer antennas that exhibit low backscatter. They can be manufactured using conductive polymers that are doped sufficiently to allow high conductivity at the RF band of operation, but are less conductive or nonconductive at higher frequencies such as those used by tracking radars (or frequencies outside the band of interest). Example applications include antennas with operating frequencies below 3 GHz, or in any case where custom tailored transmission and reflectivity properties are required. Transmission and Reflectivity performance can also be tailored for frequency of a target electromagnetic signal. Commercially available and conventional polymer fabrication techniques can be employed to tailor the conductivity's and frequency dependency as desired for a particular application and desired polymer antenna performance criteria.

The conductive polymer antenna can be created using a uniform distribution of conductive polymers across the radiating element(s) to achieve unique reflection and transmission properties as a function of frequency. Likewise, the conductive polymer antenna can be created using multiple stacked layers of the same or different conductive polymers, thereby changing the net performance of the conductive polymer antenna radiating elements to achieve unique reflection and transmission properties as a function of frequency and incidence angle.

The conductive polymer antenna can also be created using multiple stacked layers or groups of conductive polymers with a prescribed conductivity gradient to achieve unique reflection and transmission properties as a function of frequency and incidence angle. The conductive polymer antenna may use a pattern of conductive polymers on a single or multiple layers to achieve unique distribution of antenna radiating sections, or an array of radiating elements with unique reflection and transmission properties as a function of frequency and incidence angle. Likewise, the conductive polymer antenna may use multiple patterns of conductive and nonconductive regions on a surface or multiple surfaces to achieve unique distribution of antenna radiating sections, or an array of radiating elements with unique reflection and transmission properties as a function of frequency and incidence angle.

The patterns of conductive polymer and nonconductive polymer regions of the conductive polymer antenna element(s) can be achieved by weaving, plaiting, braiding, felting, twisting, roping, or interleaving conductive and non-conductive polymer strands (e.g., fibers, threads, filaments, etc) in the creation of the fabrics. These fabrics can then be laminated with a resin system to create a final formed distribution of antenna element(s) and or arrays on a surface(s). These antenna radiating surfaces can be formed into planar or multidimensional contoured surfaces.

The use of conductive polymers is thus not limited to just wire antennas such as, trailing wire, rod, monopoles, dipoles, cone, disc, discone, bicone, loops, zigzag, log-periodic, etc., but can also be applied to other antennas such as horns, reflectors, notches (including Linear tapered, Vivaldi, etc), spiral, helical, waveguide, or slots.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A low backscatter antenna having a conductive element for at least one of receiving and radiating information, the antenna comprising:

a conductive polymer center conductor having an exposed portion that forms at least a portion of the conductive element of the antenna and has a graded conductivity ranging from relatively low conductivity at its perimeter to relatively high conductivity at its center, wherein said conductive polymer center conductor is comprised of a plurality of conductive polymer strands, with strands at the perimeter having the lower conductivity and strands at the center having the higher conductivity.

2. The antenna of claim 1 further comprising:

a dielectric layer covering the unexposed portion of the conductive polymer to provide an insulating spacer; and an outer conductive polymer layer around the dielectric layer.

3. The antenna of claim 2 wherein the outer conductive polymer layer is in the form of a braid or an outer conductive jacket.

4. The antenna of claim 2 wherein the antenna is a dipole antenna formed from the exposed portion of the center conductor and an additional one or more strands of conductive polymer that is electrically coupled to the outer conductive polymer layer.

5. The antenna of claim 1 said strands at the perimeter being coated with a conductive polymer layer having lower conductivity relative to conductivity of the strands themselves, thereby providing the graded conductivity.

6. The antenna of claim 1 wherein the antenna includes a balun.

7. A low backscatter antenna having a conductive element for at least one of receiving and radiating information, the antenna comprising:

a plurality of nonconductive strands interweaved with one another;

one or more conductive polymer strands interweaved with the nonconductive strands so as to provide one or more conductive elements of the antenna; and one or more feed circuits operatively coupled to respective conductive polymer strands.

8. The antenna of claim 7 wherein each of the one or more conductive elements of the antenna has a graded conductivity ranging from relatively low conductivity at its outer surface to relatively high inner conductivity.

9. The antenna of claim 7 wherein there are N conductive polymer strands and the antenna is configured as an N/2 element dipole array.

10. The antenna of claim 9 wherein each of the N conductive polymer strands is operatively coupled to a feed circuit.

11. The antenna of claim 9 wherein a fabric formed by the nonconductive strands and the conductive polymer strands has a first side and a second side, and the conductive elements are on both sides.

12. A low backscatter antenna having a conductive element for at least one of receiving and radiating information, the antenna comprising:

a plurality of nonconductive strands formed into a fabric;

one or more conductive polymer coatings on the fabric so as to provide one or more conductive elements of the antenna; and one or more feed circuits operatively coupled to respective conductive elements of the antenna.

13. The antenna of claim 12 wherein each of the one or more conductive elements of the antenna has a graded conductivity ranging from relatively low conductivity at its outer surface to relatively high inner conductivity.

14. The antenna of claim 12 wherein at least one of the conductive elements of the antenna has a shape defined by boundaries that are not parallel to the nonconductive strands.

15. The antenna of claim 14 wherein there are N conductive elements and the antenna is configured as an N/2 element bow-tie array.

16. The antenna of claim 12 wherein the fabric has a first side and a second side, and the conductive elements are on both sides.

17. A fabric having graded conductivity comprising:

a plurality of nonconductive strands formed into a fabric; and one or more conductive polymer strands or coatings formed into or on the fabric, so as to provide one or more conductive regions of the fabric;

wherein each of the one or more conductive regions has a graded conductivity ranging from relatively low conductivity at its outer surface to relatively high inner conductivity.

* * * * *